US010309681B2

(12) United States Patent
Prihoda et al.

(10) Patent No.: US 10,309,681 B2
(45) Date of Patent: Jun. 4, 2019

(54) FABRIC AIR OUTLET DEVICE

(71) Applicant: PRIHODA s.r.o., Hlinsko (CZ)

(72) Inventors: Zdenek Prihoda, Hlinsko (CZ); Michal Bures, Hlinsko (CZ)

(73) Assignee: PRIHODA s.r.o., Hlinsko (CZ)

( * ) Notice: Subject to any disclaimer, the term of this patent is extended or adjusted under 35 U.S.C. 154(b) by 146 days.

(21) Appl. No.: 15/033,365

(22) PCT Filed: Oct. 24, 2014

(86) PCT No.: PCT/CZ2014/000119
§ 371 (c)(1),
(2) Date: Apr. 29, 2016

(87) PCT Pub. No.: WO2015/062559
PCT Pub. Date: May 7, 2015

(65) Prior Publication Data

US 2016/0258650 A1 Sep. 8, 2016

(30) Foreign Application Priority Data

Nov. 1, 2013 (CZ) ..... 2013-840

(51) Int. Cl.
*F24F 13/02* (2006.01)
*F24F 13/06* (2006.01)

(52) U.S. Cl.
CPC .. *F24F 13/0218* (2013.01); *F24F 2013/0608* (2013.01)

(58) Field of Classification Search
CPC ..... F24F 13/0218; F24F 2013/0608
USPC ..... 454/296
See application file for complete search history.

(56) References Cited

U.S. PATENT DOCUMENTS 6,565,430 B2 * 5/2003 Gebke ..... F16L 11/02 454/296
2004/0229559 A1 11/2004 Gebke et al.
2006/0252365 A1 * 11/2006 Gebke ..... F24F 11/043 454/306
2016/0207006 A1 * 7/2016 Furuyama ..... H05K 5/0213

FOREIGN PATENT DOCUMENTS

WO 03/023269 A1 3/2003

OTHER PUBLICATIONS

International Searching Authority, International Search Report and Written Opinion issued in International Application No. PCT/CZ2014/000119, dated Feb. 12, 2015, 8 pages.

* cited by examiner

*Primary Examiner* — Vivek K Shirsat
*Assistant Examiner* — Ryan L Faulkner
(74) *Attorney, Agent, or Firm* — Wood Herron & Evans LLP

(57) ABSTRACT

An air conditioning element of a woven or non-woven fabric includes a wall provided with at least a first array of through holes for distributing air, wherein the following relations apply to the through holes constituting the first array: the twofold value of the square root of the quotient between the value of the inlet area of a through hole and the value $\pi$ is less than or equal to the value of the wall thickness of the element in the region adjacent to the through hole and the center line of the through hole intersects the inlet plane of the through hole at an angle $\alpha$=60° through 89°, more preferably 80° through 88°, most preferably 83° through 87°.

12 Claims, 5 Drawing Sheets

FABRIC AIR OUTLET DEVICE

FIELD OF THE INVENTION

The present invention relates to an air conditioning element made of a woven or non-woven fabric and having its wall provided with at least a first array of through holes for distributing air.

BACKGROUND OF THE INVENTION

Known air conditioning elements for distributing air, which are made of a woven or non-woven fabric and which are also referred to as textile diffusers, typically consist of a material sewn together so as to form a closed shape having a specific cross section (ducting elements) or of a framework structure provided with a textile panels (ceiling or wall based diffusers). The element may be perforated to a certain extent, the air distribution taking place through such perforation. Distributing air in a proper manner is one of the most important functions of an air conditioning distribution system. As far as the known ducting elements are concerned, various sizes of through holes/perforations for distributing air have been used. In particular, such known arrangements of through holes consist in that the axis of each of the through holes is substantially perpendicular to the plane of the material of the respective air conditioning element or, as the case may be, in that such axis extends in a radial direction with respect to the ducting element.

A certain drawback of the known air conditioning ductwork may become particularly evident in the locations where the longitudinal velocity of the air delivered by a fan or blower is high. This mainly occurs in the vicinity of the inlet area of such ductwork. This is, however, accompanied with an undesirable effect that consists in that the air being led away from the through holes is not flowing in a radial direction, i.e. perpendicularly to the respective ducting element, but in a different direction comprising a vector component that corresponds to the direction of the air flow inside the same ducting element.

A further drawback, which mainly relates to the known ceiling framework structures comprising textile outlets, consists in that an undesirable draught can develop in the case that the distributed air is flowing in a single direction from such an outlet.

Various experiments have been performed in an effort to obtain an outlet air flow which would be perpendicular to the walls of air conditioning elements made of textile, i.e. relatively thin-walled, materials. For example, various directing members arranged inside a ducting element or various external deflecting members have been tried out.

The objective of the present technical solution is to develop an improved air conditioning element for distributing air. Such air conditioning element has to be simple with regard to design and manufacturing, and enable directing of the outlet air flow in a manner that will cause the distributed air to leave the air conditioning to element in a direction perpendicular to the surface of the latter, or that will, preferably, cause the distributed air to flow in multiple desirable directions when leaving different portions of the air conditioning element. At the same time, all the advantages of a textile or foil distribution system must be maintained. In particular, the components of such a distribution system must remain machine-washable.

SUMMARY OF THE INVENTION

The applicant has found out that the air can be directed even in the case that the same is flowing through an air conditioning element having relatively thin walls. This can be accomplished in that very small orifices are provided having their centre lines inclined with respect to a straight line extending perpendicularly to the wall of the respective air conditioning element. Surprisingly, a very small inclination with respect to said perpendicular straight line is sufficient for obtaining a perpendicular/radial outlet airflow provided that the size of said orifices is relatively small with respect to the thickness of the material surrounding the given orifice, i.e. with respect to the thickness of the material in which that orifice is formed.

Thus the above aim is achieved by an air conditioning element made of a woven or non-woven fabric and having its wall provided with at least a first array of through holes for distributing air, wherein the following relations apply to the through holes constituting said first array: the twofold value of the square root of the quotient between the value of the inlet area of a through hole and the value $\pi$ is less than or equal to the value of the wall thickness of the element in the region adjacent to said through hole and the centre line of each through hole intersects the inlet plane of said through hole at an angle $\alpha$=60° through 89°, more preferably 80° through 88°, most preferably 83° through 87°.

According to a preferred embodiment the centre lines of the through holes constituting the first array are parallel to each other or extend along identical and/or mutually parallel conical surfaces.

According to a different preferred embodiment at least some of the centre lines of the through holes constituting the first array are mutually concurrent.

It may be also advantageous when the wall of the air conditioning element comprises at least one second array of through holes to which the following relations apply: the twofold value of the square root of the quotient between the value of the inlet area of a through hole and the value $\pi$ is less than or equal to the value of the wall thickness of the element in the region adjacent to said through hole of the second array and the centre lines of the through holes belonging to the second array intersect the inlet planes of said through holes at an angle $\beta$=60° to 90°, more preferably 80° to 90°, most preferably 83° to 88°, said centre lines (O2) being not parallel to the centrelines of the through holes belonging to the first array. The value of the angle $\alpha$ may differ from that of the angle $\beta$.

The through holes belonging to at least one of the arrays may taper from their inlet sections towards their outlet ones.

In case the element is a duct having an inlet end and an outlet end, the centre lines of the through holes arranged in the vicinity of the inlet end of the element may intersect the inlet planes of the respective through holes at an angle $\alpha$ that is less than the angle $\alpha$ formed by the centre lines of the through holes arranged in the vicinity of the outlet end of the element.

In case the wall of the element is formed by a textile fabric filling up a rectangular or circular framework structure, the centre lines of the through holes may be inclined with respect to the inlet planes of said holes, the inclination of said centre lines being adapted for directing the air in a manner enabling the air flow leaving the element to whirl.

The wall of the element (1) may be formed by a textile fabric filling up a framework structure and sewn together so as to assume the shape of a triangular or multiangular pyramid, while the through holes may be formed in the individual side walls of said pyramid.

BRIEF DESCRIPTION OF THE DRAWINGS

The present invention will be further described in more detail with reference to the accompanying drawings showing exemplifying embodiments, wherein.

DESCRIPTION OF EXEMPLARY EMBODIMENTS

Figure 1A:
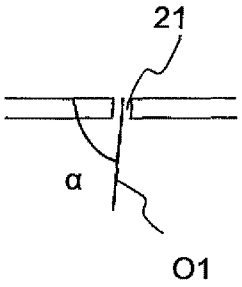
FIG. 1A shows a portion of the element of FIG. 1 in a detailed view.
Figure 1:
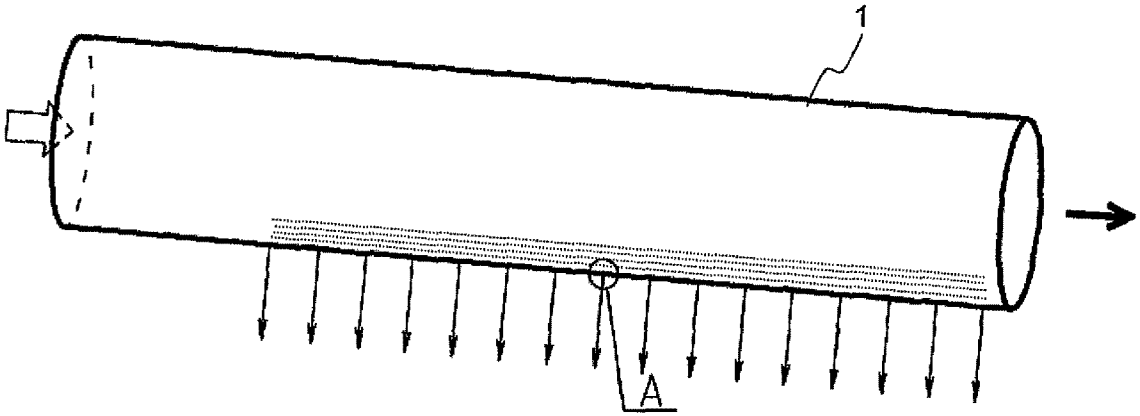
FIG. 1 shows the first embodiment of an air conditioning element having the form of a textile ductwork provided with through holes.

The first exemplary embodiment of the element 1 according to the invention, which is shown in FIG. 1, comprises a textile duct having a circular cross section, said duct having one of its regions provided with an array of through holes 21. This embodiment is intended for transporting and distributing air, the latter entering the element 1 by means of the inlet orifice (from the left in FIG. 1) and leaving the same both by means of the through holes 21 and by means of the outlet orifice (to the right in FIG. 1), said outlet orifice being typically connected to another downstream ducting element (not shown). The through holes 21 may have circular or different shapes, the present invention, however, being based on the assumption that said holes are small in proportion to the thickness t of the material forming the wall of the element 1. Circular through holes 21 should have their diameter d less than or equal to the thickness of the wall of the element 1. Since the cross-sectional area of a non-circular hole can be always converted into that of a circular hole, the following equation should be applicable for the holes of the given array:

$$t \geq 2\sqrt{\frac{S}{\pi}}$$

In the above equation, t is the thickness of the material of the element in the surroundings of the respective through hole 21 (which substantially corresponds to the length of the through hole) and S is the inlet cross-sectional area of the same through hole. The underlying general assumption consists in that, with regard to the thicknesses of the textile materials the air conditioning elements are typically made of, the diameter of circular through holes should be at most 0.6 mm. Nevertheless, the type of the material used should be considered.

The arrows indicate the flow direction of the distributed air.

The inlet of a through hole 21 is considered to be that portion of the same, which is entered by the distributed air, while the outlet of the same through hole 21 is considered that portion of the same which is left by the air flowing into the space around the element.

FIG. 1A schematically shows the detail A of FIG. 1. As also indicated in FIG. 1A, the centre line O1 of the through hole 21 interconnects the centre of the inlet cross-sectional area of the trough hole and the centre of the outlet cross-sectional area of the same (the cross-sectional areas of the through holes 21 may gradually decrease towards the outlet sections—not shown). The centre line O1 of the through hole 21 intersects the plane, along which the inlet cross-section of that through hole extends, at the angle $\alpha$, said angle being less than 90°. In other words, the centre line O1 is generally not perpendicular to the direction of the air flow inside the element 1, i.e., it does not lie in the radial plane of the ducting element 1 but intersects the streamline of the air flow inside the ductwork at an angle which is less than ninety degrees.

Regarding the cylindrical surface of the element 1, it is evident that the centre lines O1 of the individual through holes are not parallel to each other. In the case of the simplest structural arrangement, those centre lines may all extend along identical and/or mutually parallel conical surfaces and intersect the respective inlet cross-sectional planes at an equal angle $\alpha$. In a preferred embodiment, however, the centre lines O1 of the through holes 21 arranged in the vicinity of the inlet portion of the ducting element 1 intersect the respective inlet cross-sectional planes at an angle $\alpha$ that is less (more acute) than the angle formed by the centre lines O1 of the through holes 21 arranged in the vicinity of the outlet portion of the ducting element 1.

Figure 2A:
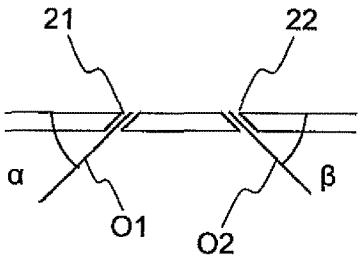
FIG. 2A shows the portion B of the element of FIG. 2 in a detailed view.
Figure 2:
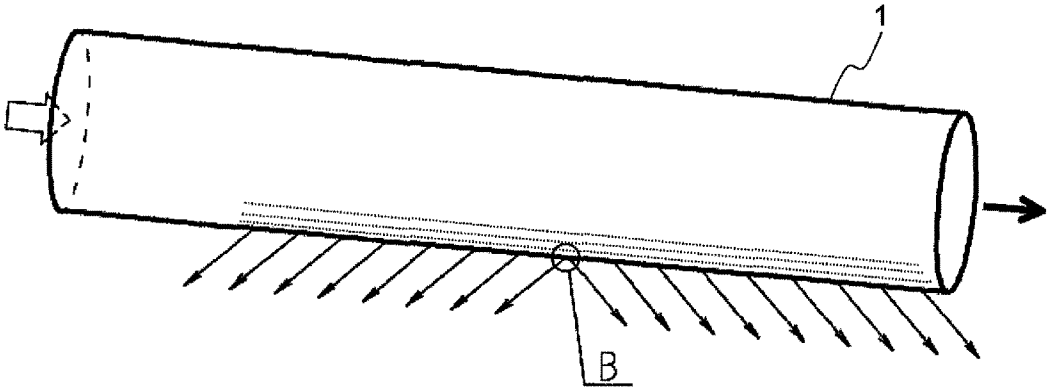
FIG. 2 shows the second embodiment of an air conditioning element having the form of a textile ductwork provided with through holes.

FIG. 2 shows an arrangement, which is similar to that shown in FIG. 1, the substantial difference, however, consisting in that the element shown in FIG. 2 is provided with two arrays of the through holes 21, 22. The through holes 21, which are arranged in the first array, divert the distributed air in a first direction, and the through holes 22, which are arranged in the second array, divert the same in a second direction. For this purpose, the centre line O1 of each of the through holes 21 arranged in the first array intersects the inlet cross-sectional plane of the respective through hole at an angle $\alpha$ while the centre lines O2 of the through holes 22 arranged in the second array intersect the inlet cross-sectional plane of the respective through holes 22 at an angle $\beta$, which can be equal to or different from the angle $\alpha$, the centre lines O1, however, extending along identical and/or mutually parallel conical surfaces that are not parallel to the conical surfaces along which the centre lines O2 extend. Thereby, the first portion of the element distributes the air in the one direction (obliquely to the left, as shown in FIG. 2) and the second portion of the element distributes the air in the other direction. Such an arrangement can improve the air distribution in all the parts of the given room being air conditioned. FIG. 2A shows a detail of the element 1 of FIG. 2, the detailed view illustrating one of the through holes 21 arranged in the first array and one of the through holes 22 arranged in the second array.

Figure 3A:
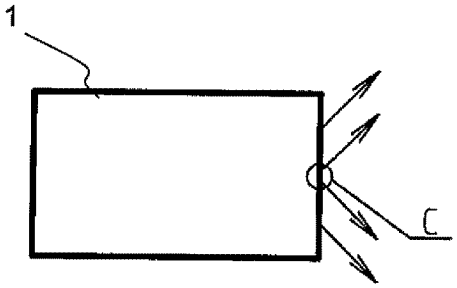
FIG. 3A shows the element of FIG. 3 in a side-elevation view.
Figure 3B:
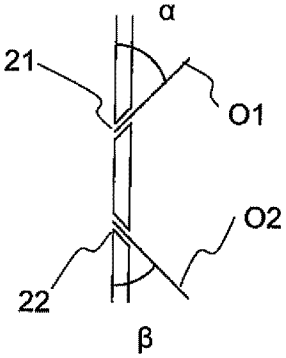
FIG. 3B shows a portion of the element of FIG. 3A in a detailed view.
Figure 3:
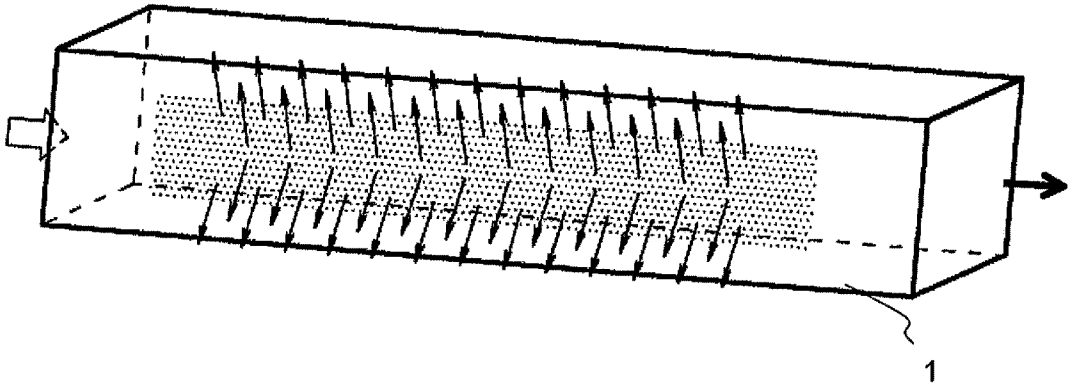
FIG. 3 shows the third embodiment of an air conditioning element having the form of a textile ductwork provided with through holes.

FIGS. 3 and 3A show the air conditioning element 1 having the form of a ductwork with a rectangular cross section. One of the walls of the element 1 is provided with two arrays of the through holes 21, 22. The boundary between the first array of the through holes 21 and the second array of the through holes 22 is formed by the line extending in the longitudinal direction of the element 1, i.e., in the direction of the air flow inside the element 1. The centre lines O1 are substantially parallel to each other and the centre lines O2 are also substantially parallel to each other but those centre lines O1 and O2, which lie in a common plane, are mutually concurrent, thus forming an angle of, e.g., 60° or less. In an alternative preferred embodiment, the centre lines O1 and O2 may be additionally inclined with respect to the inlet cross-sectional planes of the respective through holes 21, 22 at such angles that the through holes can balance the influence of the velocity of the air flow in the vicinity of the inlet end of the element 1 that is higher than that at the outlet end of the element 1. In other words, the centre lines of the through holes 21, 22 near to the inlet part of the element 1 may be inclined more towards the inlet end than the centre lines O1, O2 of the through holes 21, 22 arranged in the area near to the outlet part of the element 1. FIG. 3B shows a detail of the element 1 of FIG. 3A, the detailed view illustrating one of the through holes 21 arranged in the first array and one of the through holes 22 arranged in the second array.

Figure 4A:
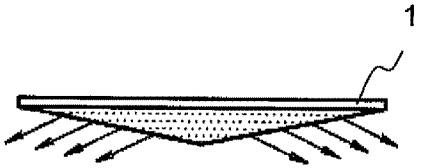
FIG. 4A shows the element of FIG. 4 in a side-elevation view.
Figure 4B:
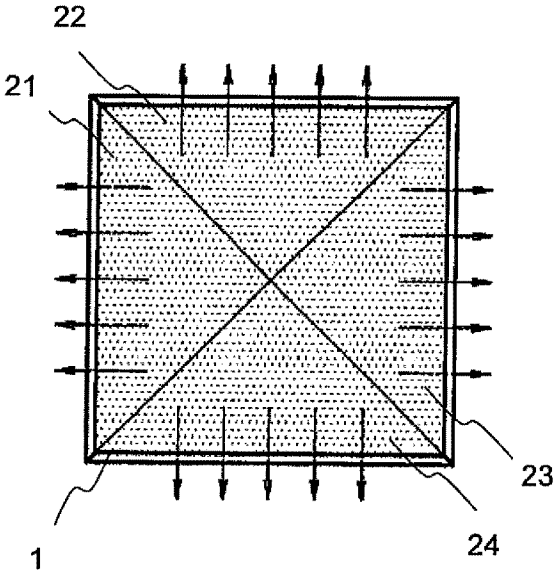
FIG. 4B shows is the element of FIG. 4 in a plan view.
Figure 4:
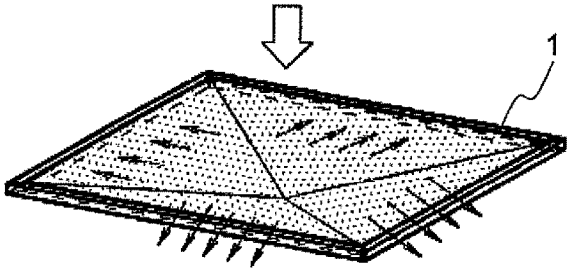
FIG. 4 shows the forth embodiment of an air conditioning element in a perspective view, the element assuming the form of a square framework structure filled with a textile fabric.

FIG. 4 shows an element 1 in a schematical perspective view, the element assuming the form of a framework structure having a square cross section and filled with a perforated textile fabric sewn together so as to assume the shape of is a square pyramid. The perforation is formed by through holes 21 forming a first array of through holes in the first wall of the pyramid, by the through holes 22 forming a second array of through holes in the second wall of the pyramid, by the through holes 23 forming a third array of through holes in the third wall of the pyramid, and by the through holes 24 forming a fourth array in the fourth wall of the pyramid. The element 1 diverts the air flow in four directions, each of said directions leading obliquely away from the element and intersecting the plane of the framework of the element 1 at a very acute angle and the inlet cross-sectional plane of the respective through walls 21, 22, 23, 24 at a less acute angle, preferably at an angle between 60 and 89 degrees. Thereby, the desirable air distribution is accomplished in all the parts of the room being air conditioned.

Figure 5A:
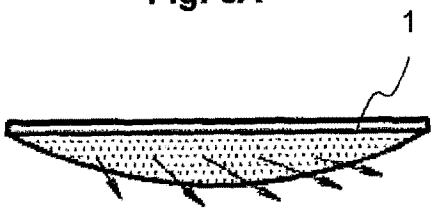
FIGS. 5A and 5B show the element of FIG. 5 in a side-elevation view and a plan view, respectively. The arrows shown in the above FIGS. indicate the respective airflow directions.
Figure 5B:
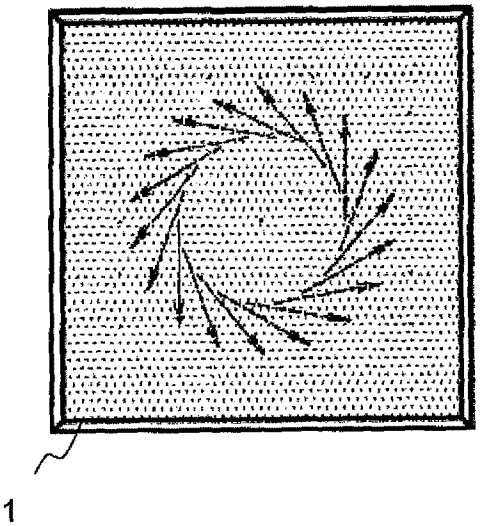
Figure 5:
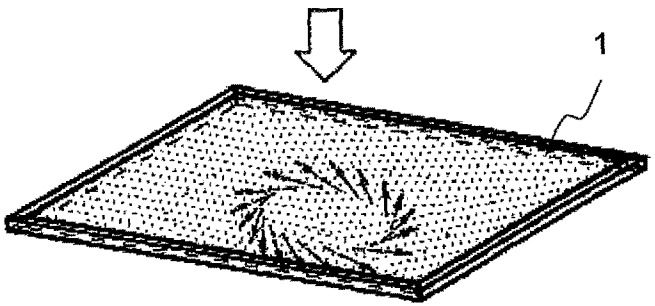
FIG. 5 shows the fifth embodiment of an air conditioning element in a perspective view, the element having the form of a framework structure filled with a textile fabric.

FIG. 5 shows an element 1 in a perspective view, the element assuming the form of a framework structure having a square cross section and filled with a perforated textile fabric shaped as a spherical cap or a similar rounded formation. Again, each of the through holes 21 has its centre line O1 that is inclined with respect to the inlet cross-sectional plane of the given through hole at an angle less than 90°, preferably at an angle between 60 and 89 degrees. The inclination of the centre lines of the through holes 21 makes the air flow leaving the element 1 to whirl. Preferably, the centre lines O1 are formed by straight lines lying in the planes that are tangent to imaginary cylindrical surfaces or, as the case may be, conical ones, said surfaces having a common axis extending perpendicularly to the plane of the framework structure of the element 1, preferably intersecting the midpoint of said plane. An advantageous way of directing the air flow is indicated in FIGS. 5, 5A and 5B. In an exemplary preferred embodiment, the centre lines O1 of the through holes 21, which lie on a common surface line interconnecting the midpoint of the textile stuffing fabric and the framework structure along the shortest path possible, intersect the inlet planes of the respective through holes at a substantially equal angle $\alpha$.

The inclinations of the centre lines O1, O2 are indicated schematically in the drawings. For illustration purposes, the angles $\alpha$ and $\beta$ shown in the drawings are more acute than really required angles. The suitable numerical values of the individual angles are defined both in the patent specification and in the appended patent claims.

Preferably, the through holes may be laser burnt into the textile material, the inclination of the laser beam with respect to the fabric determining the inclination of the centre line of the given through hole.

A particular exemplary embodiment of the present invention comprises a diffuser having a circular cross section and having 6 m in length and 250 mm in diameter, which particular diffuser supplies into the respective room air at a volumetric flow rate of 1350 $m^3/h$. The diffuser is made of a PMS fabric, i.e., from a fabric comprised of infinite filaments made of 100% polyester and having a basis weight of 200 $g/m^2$ (according to the standard EN 12127), a thickness of 0.30 mm (according to the standard EN ISO 5084), a simple textile bond (according to the standard EN 1049-2, warp/weft), a warp/weft strength of 1830/1020 N (according to the standard EN ISO 13934-1) and a permeability of 45 $m^3/h/m^2$ related to the pressure of 120 Pa.

If the through holes for air distribution were formed perpendicularly to the surface of the fabric, the distributed air would adhere to the external surface of the diffuser due to the higher longitudinal velocity of the air flow (e.g., 7.64 m/s) at the beginning of the diffuser and a draught would form below the end of the same. The embodiments of the diffuser according to the present invention can eliminate the above undesirable effect as follows: The through holes 21 for distributing the air supplied into a room have a tapered shape, the inlet diameter being 0.24 mm and the outlet diameter being 0.20 mm. The through holes are burnt into the fabric so that their centre lines intersect the inlet cross-sectional planes of the respective through holes (generally corresponding to the direction of air flow inside the ducting outlet) at an angle of 86°. The distributed air is evenly spatially dispersed below the ducting outlet which is desirable for a proper ventilation of the respective room. Moreover, a more acute angle can be formed near to the entry area of the diffuser and a substantially right angle can be formed near to the end of the diffuser. Nevertheless, a practical application can be based on preventing the air flow from adhering to the wall of the diffuser in a sufficient manner. This can be accomplished through the above described constant obliqueness.

Although multiple exemplary embodiments are described above, it is obvious that those skilled in the art would easily appreciate further possible alternatives to those embodiments. Hence, the scope of the present invention is not limited to the above exemplary embodiments and it is rather defined by the attached claims.

The invention claimed is:

1. An air conditioning element made of a woven or non-woven fabric comprising:

a wall having at least a first array of through holes therein for distributing air, the through holes having side walls, each through hole has a diameter in the range of 0.20 mm and 0.60 mm, wherein the following relations apply to the through holes in the wall constituting the first array:

a twofold value of the square root of the quotient between a value of an inlet area of the through hole and the value π is less than or equal to a value of a wall thickness of the element in a region adjacent to said through hole, and a centre line of the through hole intersects an inlet plane of the through hole at an angle α between 60° and 89°.

2. The air conditioning element according to claim 1, wherein the centre lines of the through holes constituting the first array are parallel to each other, extend along identical conical surfaces, or extend along mutually parallel conical surfaces.

3. The air conditioning element according to claim 1, wherein at least some of the centre lines of the through holes constituting the first array are concurrent.

4. The air conditioning element according to claim 1, wherein the wall has at least one second array of through holes therein for distributing air, the through holes having side walls, wherein the following relations apply to the through holes in the wall constituting the second array:

a twofold value of the square root of the quotient between a value of an inlet area of the through hole and the value π is less than or equal to a value of the wall thickness of the element in a region adjacent to said through hole of the second array, and centre lines of the through holes constituting the second array intersect inlet planes of said through holes at an angle β between 60° and 90°, said centre lines being not parallel to the centre lines of the through holes constituting the first array;

wherein the inlet area of the through holes in the second array is the same as the inlet area of the through holes in the first array.

5. The air conditioning element according to claim 4, wherein the value of the angle α is different from that of the angle β.

6. The air conditioning element according to claim 4, wherein the sides walls of the through holes of the first array being parallel to the centre line of those through holes, and wherein the side walls of the through holes in the second array are parallel to the centre line of those through holes.

7. The air conditioning element according to claim 4, wherein each through hole in the second array has a diameter in the range of 0.20 mm and 0.60 mm.

8. The air conditioning element according to claim 1, wherein the element is a duct having an inlet end and an outlet end and the centre lines of the through holes arranged in a vicinity of the inlet end of the element intersect the inlet planes of the respective through holes at an angle α relative to a longitudinal axis of the duct that is less than the angle α formed by the centre lines of the through holes arranged in a vicinity of the outlet end of the element.

9. The air conditioning element according to claim 1, wherein the wall of the element is formed by a textile fabric filling up a rectangular or circular framework structure and the centre lines of the through holes are inclined with respect to the inlet planes of said through holes, the inclination of said centre lines being adapted for directing air in a manner enabling an air flow leaving the element to whirl.

10. The air conditioning element according to claim 1, wherein the wall of the element is formed by a textile fabric filling up a framework structure and sewn together so as to assume the shape of a triangular or a multiangular pyramid.

11. The air conditioning element according to claim 1, wherein the side walls of the through holes of the first array being parallel to the centre line of those through holes.

12. The air conditioning element according to claim 1, wherein the distributed air exits the through holes in a direction perpendicular to the wall.

* * * * *